US005678762A

United States Patent [19]

Wood et al.

[11] Patent Number: 5,678,762

[45] Date of Patent: Oct. 21, 1997

[54] RAILWAY RAIL FASTENING ASSEMBLIES INCLUDING RESILIENT RAILWAY RAIL FASTENING CLIPS AND ASSOCIATED INSULATORS

[75] Inventors: Timothy Alan Wood, Sturton-by-Stow; Kevin Stubbs, Sheffield; Stephen John Cox, Richmond; Martin David Somerset; Brian George Conroy, both of Worksop, all of United Kingdom

[73] Assignee: Pandrol Limited, Addlestone, United Kingdom

[21] Appl. No.: 557,859

[22] Filed: Nov. 14, 1995

[30] Foreign Application Priority Data

Nov. 16, 1994 [GB] United Kingdom ..... 9423255

[51] Int. Cl.[6] ..... E01B 9/00

[52] U.S. Cl. ..... 238/351

[58] Field of Search ..... 238/310, 315, 238/338, 349, 351, 352, 353, 354, 377

[56] References Cited

U.S. PATENT DOCUMENTS

| | | | |
|---|---|---|---|
| Re. 28,291 | 12/1974 | Borup et al. | 238/349 |
| 3,065,914 | 11/1962 | Rigby | 238/349 |
| 4,489,885 | 12/1984 | Bryan | 238/349 |

FOREIGN PATENT DOCUMENTS

| | | | |
|---|---|---|---|
| 0138691 | 4/1985 | European Pat. Off. . | |
| 1158978 | 6/1958 | France | 238/351 |
| 97650 | 3/1961 | Norway | 238/349 |
| 696418 | 2/1950 | United Kingdom . | |
| 1330382 | 6/1970 | United Kingdom . | |

*Primary Examiner*—Mark T. Le

*Attorney, Agent, or Firm*—Norbert P. Holler; Gottlieb, Rackman & Reisman, P.C.

[57] ABSTRACT

In an assembly for use in fastening a railway rail to an underlying rail foundation, a resilient railway rail fastening clip (1, 2,3) has at least one portion (1*a*) which when in use bears on, and extends substantially parallel to, a flange (301) of an adjacent railway rail (300), and retains an insulator (13, 13') for electrically insulating the clip (1, 2, 3) from the rail (300) when in use. The insulator (13) is held in engagement with the clip (1, 2, 3), which has a rail bearing portion of substantially circular cross-section, such that it can rotate about the longitudinal axis of the said rail bearing portion (1*a*). Unlike the prior art the insulator is self-aligning on the rail flange (301) when the rail (300) moves. One insulator (13, 13') disclosed has at least two load bearing surfaces (13*a*), such that it may be rotated so as to present an unworn load bearing surface (13*a*) to the rail flange (301). The thickness of material between the load bearing surfaces (13*a*) of the insulator (13, 13') and the rail bearing portion (1*a*) of the clip (1, 2, 3) may be made to vary between adjacent load bearing surfaces (13*a*), such that the insulator (13) can be rotated so as to adjust the height of the rail bearing portion (1*a*) above the rail flange (301).

15 Claims, 8 Drawing Sheets

FIG. 1
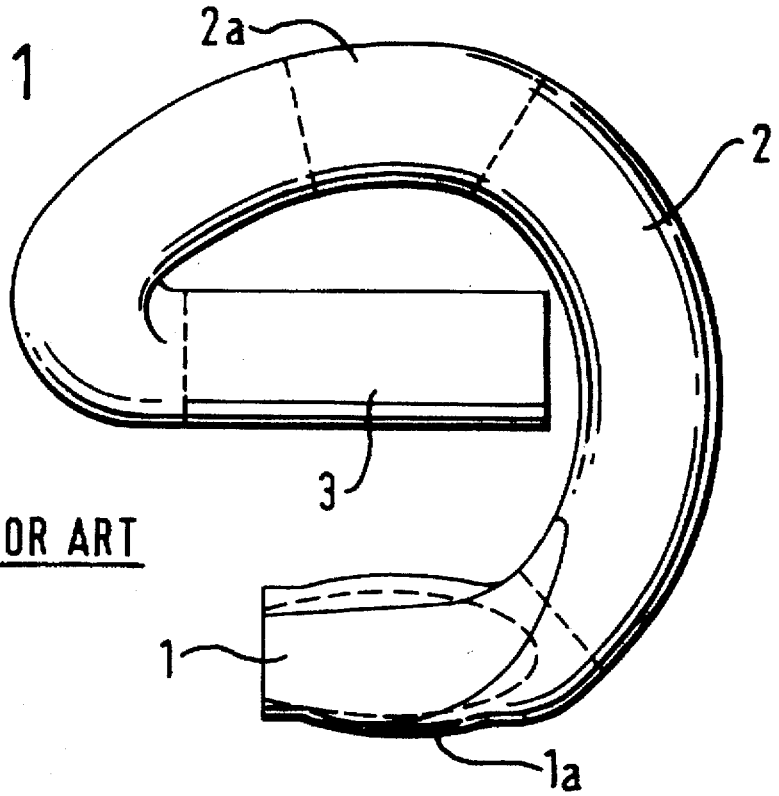
PRIOR ART
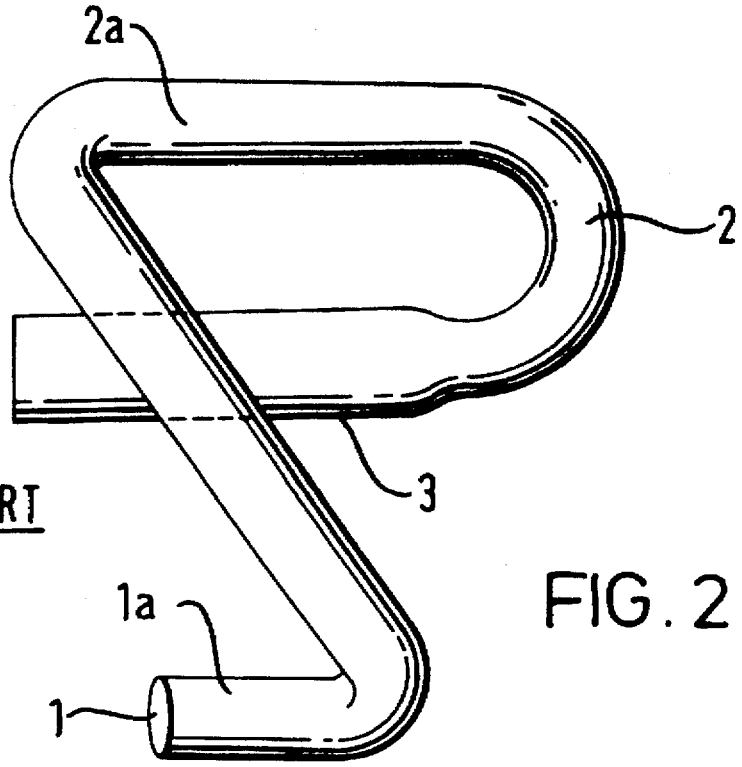
PRIOR ART
FIG. 2

FIG.6a
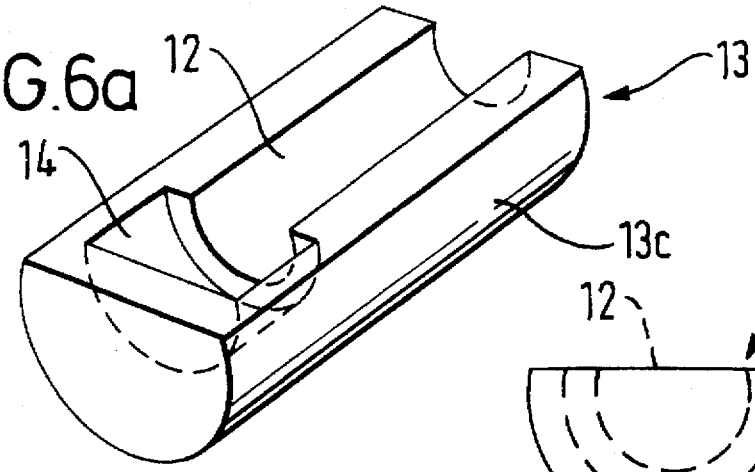
FIG.6b
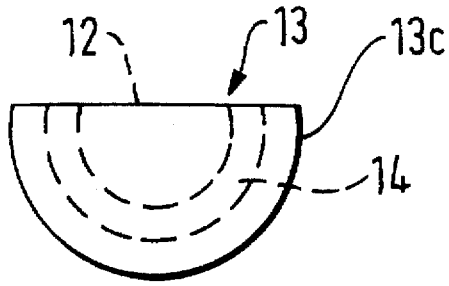
FIG.7a
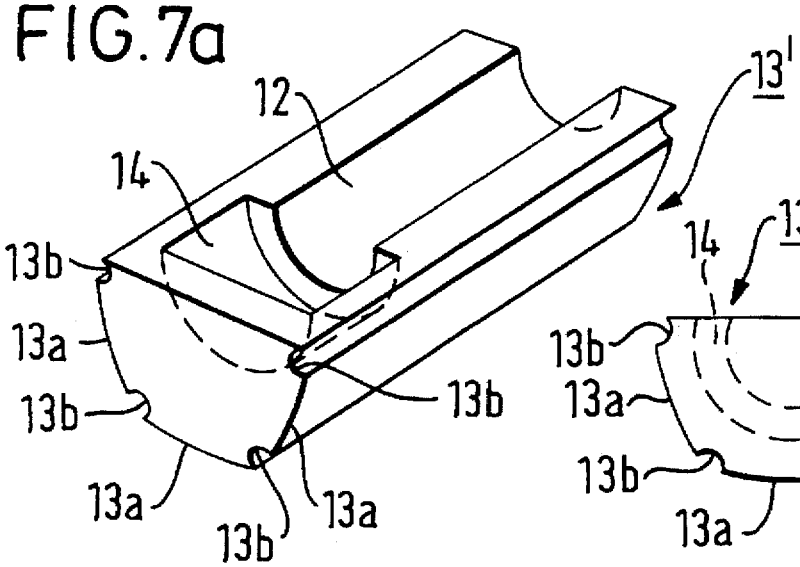
FIG.7b
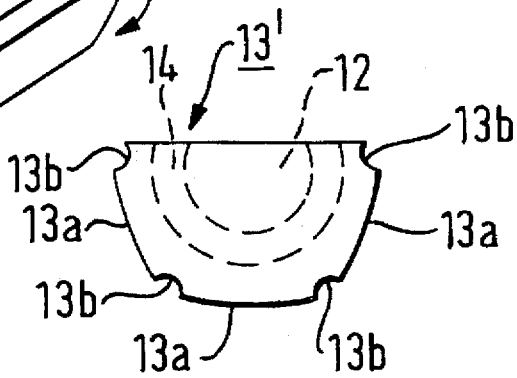
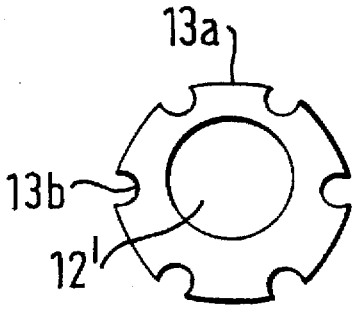
FIG. 9

RAILWAY RAIL FASTENING ASSEMBLIES INCLUDING RESILIENT RAILWAY RAIL FASTENING CLIPS AND ASSOCIATED INSULATORS

BACKGROUND OF THE INVENTION

The present invention relates to railway rail fastening assemblies including resilient railway rail fastening clips and associated insulators.

1. Field of the Invention

For the purpose of providing electrical insulation, it has become common to incorporate polymer or elastomeric materials between otherwise contacting parts in railway rail fastening assemblies. Typically, a sheet of elastomer is placed underneath the rail at a rail fastening location, which also provides cushioning, and a suitably shaped insulator is positioned around the side and upper surface portion of a rail flange onto which a rail fastening clip bears. However, known insulators suffer from a number of disadvantages.

2. Description of the Prior Art

In WO93/12295, the present applicant proposed a new form of insulator in which the toe and post portions are separate, the clip carrying the toe portion of the insulator and the post portion of the insulator being held in place by the anchoring device. In separating the two portions of the insulator, an insulator system is provided in which it is possible to fit the post insulator to a clip anchoring device before the rail is laid, thereby facilitating track installation by simplifying the job of fitting insulators and reducing the number of loose components delivered to the site of installation. Furthermore, the use of separate toe and post insulators allows the post insulator to be replaced separately from the toe insulator, and vice versa.

Prior art "captive" toe insulators, such as that disclosed in WO93/12295 which clip onto a bend in the rail fastening clip and that disclosed in GB-A-2106571 which is glued onto the clip, are firmly secured to the clip and present a fixed bearing surface to the rail foot. During dynamic displacements of the rail under load, therefore, the position of the contact point between the toe insulator and the rail flange, and the size of the bearing area, vary such that in these conditions certain parts of the toe insulator are subjected to undesirably high pressure, thereby accelerating wear of the toe insulator. In addition, not only must a different toe insulator be provided for each shape of rail flange, but moreover, in practice, it can be extremely difficult to manufacture a toe insulator such that the load bearing face of the insulator conforms accurately to the angle of the rail flange.

SUMMARY OF THE INVENTION

According to an embodiment of the present invention there is provided an assembly for use in fastening a railway rail to an underlying rail foundation, which assembly comprises a resilient railway rail fastening clip, having at least one portion of substantially circular cross-section which when in use bears on, and extends substantially parallel to, a flange of an adjacent railway rail, and an insulator for electrically insulating the clip from the rail which is retained on the rail bearing portion of the clip when in use, wherein the insulator is held in engagement with the clip such that the insulator is mounted for rotational displacement about the longitudinal axis of the said rail bearing portion, whereby the insulator is self-aligning on the rail flange.

Thus, an insulator embodying the present invention is held in engagement with the clip such that it is free to rotate, at least partly, about the longitudinal axis of the rail bearing portion of the clip. It should be noted that in the present specification rotational displacement is intended to mean a movement about the longitudinal axis of the rail bearing portion of the clip which is not necesarily through 360°, and may indeed be very much smaller.

The self-alignment of the assembly is such that whatever the geometry of the rail fastening arrangement there is always a normal contact between the insulator and the rail flange. In other words, in contrast to the prior art a clip and insulator assembly embodying the present invention is self-conforming to the actual contact geometry between the rail bearing portion of the clip and the rail flange. This self-aligning capability of the insulator on the clip enables the same clip and insulator assembly to be employed in a wide range of fastening installations, even where the design of various other components of the installation (such as the design of the rail flange) vary.

In certain locations on the track, including curves, points and crossings for example, there may be significant rolling motion of the rail. Thus, in addition to the self-aligning capability of the present invention, an assembly embodying the second aspect of the present invention has the further advantages of being able to accommodate such dynamic movement of the rail under load without frictional abrasion at the bearing contact point, thus extending toe insulator life, and being able to protect the clip from high lateral strains, since the rotation of the insulator prevents loads from being induced in the clip. Thus, a simple change to existing types of clip can result in significant improvements to a variety of widely-used rail fastening assemblies.

Either the insulator, the rail bearing portion of the clip or both are provided with means, permitting rotational displacement of the insulator, for limiting longitudinal displacement of the insulator on the rail bearing portion during driving of the clip onto the rail flange.

Thus, in a clip and insulator assembly embodying the present invention the rail bearing portion of the rail fastening clip may include an axially-local change or displacement in transverse cross-section which is adapted to engage with a corresponding change in internal cross-section of a toe insulator for attachment to the rail bearing portion to limit displacement of the insulator on the rail bearing portion so as to counter any tendency during installation, and/or in use, for the insulator to move too far along the rail bearing portion.

The change or displacement in transverse section preferably, but not exclusively, comprises: one or more recesses or circumferential grooves for engaging with corresponding projections on the insulator; an offset, which may or may not involve any change in the transverse section, one or more tabs, or circumferential protrusions for engaging with corresponding recesses or grooves on the internal surface of the insulator; a threaded portion for engaging with a corresponding thread on the insulator; one or more tabs acting as stops at one or both ends of the rail bearing portion of the clip; a local narrowing of axial cross-section which is such that the insulator can move freely about the narrowed part, but cannot move beyond it as the unnarrowed diameter of the clip is greater than the passageway or recess of the insulator; or other reduction or increase in width or diameter of the rail bearing portion, as appropriate.

In one embodiment of the present invention the insulator has two or more load bearing surfaces, and the insulator may be rotationally displaced so as to change which of the load bearing surfaces of the insulator is presented to the rail flange.

In particular, the insulator may be rotated about the rail bearing portion so as to present an unworn load bearing surface to the rail flange.

Alternatively, if the thickness of material between the load bearing surfaces and a surface of the insulator which contacts the rail bearing portion of the clip is made to vary between adjacent load bearing surfaces, then an insulator embodying the present invention can be rotated so as to adjust the height of the rail bearing portion above the rail flange. In this respect, the height of a rail, sitting on an elastomeric pad, with respect to an adjacent anchoring device will gradually decrease as the pad wears. This causes a reduction of the toe load exerted on the rail by the clip. To avoid the need to lift the rail in order to replace the worn pad, an insulator with an offset recess or passageway can be rotated such that the deflection of the clip is increased, hence increasing the toe load exerted by the clip. Similarly, if a difference in toe load is required for other reasons, for example a change in rail traffic or on bends, the insulator may be employed to adjust the toe load applied by the clip without the need to change the insulator or the clip itself. Furthermore, such a clip and insulator assembly may reduce the cost, and facilitate construction, of new track, since the height of the shoulders need be set only approximately and the insulator rotated so as to adjust the installation to the correct height.

The exterior of an insulator embodying the present invention may be of any shape. For example, embodiments of the insulator may have one, two, three, four, five, six or more load bearing surfaces. In one embodiment, the insulator has a polygonal, or part-polygonal, cross-section. There may be a radius on the or each load bearing surface which may vary and may be such as to aid self-alignment of the insulator. For example, the or each load bearing surface may be shaped such that the cross-section of the insulator is circular or elliptical, or part-circular or part-elliptical. One or more of the load bearing surfaces themselves may be part-cylindrical (circular or elliptical). Each load bearing surface of an insulator embodying the present invention is preferably, but not essentially, of substantially equal size.

An insulator embodying the present invention may be formed with a longitudinal recess shaped so as to clip onto the rail bearing portion of the clip, or with a passageway therein to receive the rail bearing portion of the clip. This recess or passageway may have a blank or open end. In a preferred embodiment, the passageway or longitudinal recess is located such that the insulator and the rail bearing portion of the clip are co-axial, but in an insulator embodying the present invention the passageway or recess need not be centrally located in the insulator, so it may be employed for height adjustment, as described above.

An assembly embodying the present invention can employ any one of a number of different types of rail fastening clip, providing the rail bearing portion of the clip extends substantially parallel to the line of the rail, has a substantially circular cross-section and can be appropriately adapted so as to limit longitudinal displacement of the insulator therealong. Examples of clips which may be advantageously employed include those described in: GB-1,510,224 (known as "e"-clips), GB-861,473 (known as "PR" clips), GB-A-2,211,229 (known as "Sonata" clips), WO93/12296 ("M"-clips), EP-A-0401424 ("SKL" clips) or U.S. Pat. No. 4,304,359 ("Z"-clips). This list is not exhaustive. The "e"-clip, "Sonata"-clip and "Z"-clip have a rail bearing portion which is at one of the free ends of the clip. The "SKL" clip has two free ends which bear on the rail. The "M"-clip has a portion between the two inner legs of the "M" which bears on the rail. The rail bearing portion of a "PR" clip is a bent part of the clip located between two arches thereof.

BRIEF DESCRIPTION OF THE DRAWINGS

FIGS. 1 and 2 show respective plan views of e-shaped and Z-shaped clips;

FIGS. 6*a* and 6*b* show respective perspective and end-on views of an insulator for use in an assembly embodying the present invention;

FIGS. 7*a* and 7*b* show respective perspective and end-on views of another insulator for use in an assembly embodying the present invention;

FIG. 9 shows an end-on view of another insulator for use in an assembly embodying the present invention;

DETAILED DESCRIPTION

Figure 3:
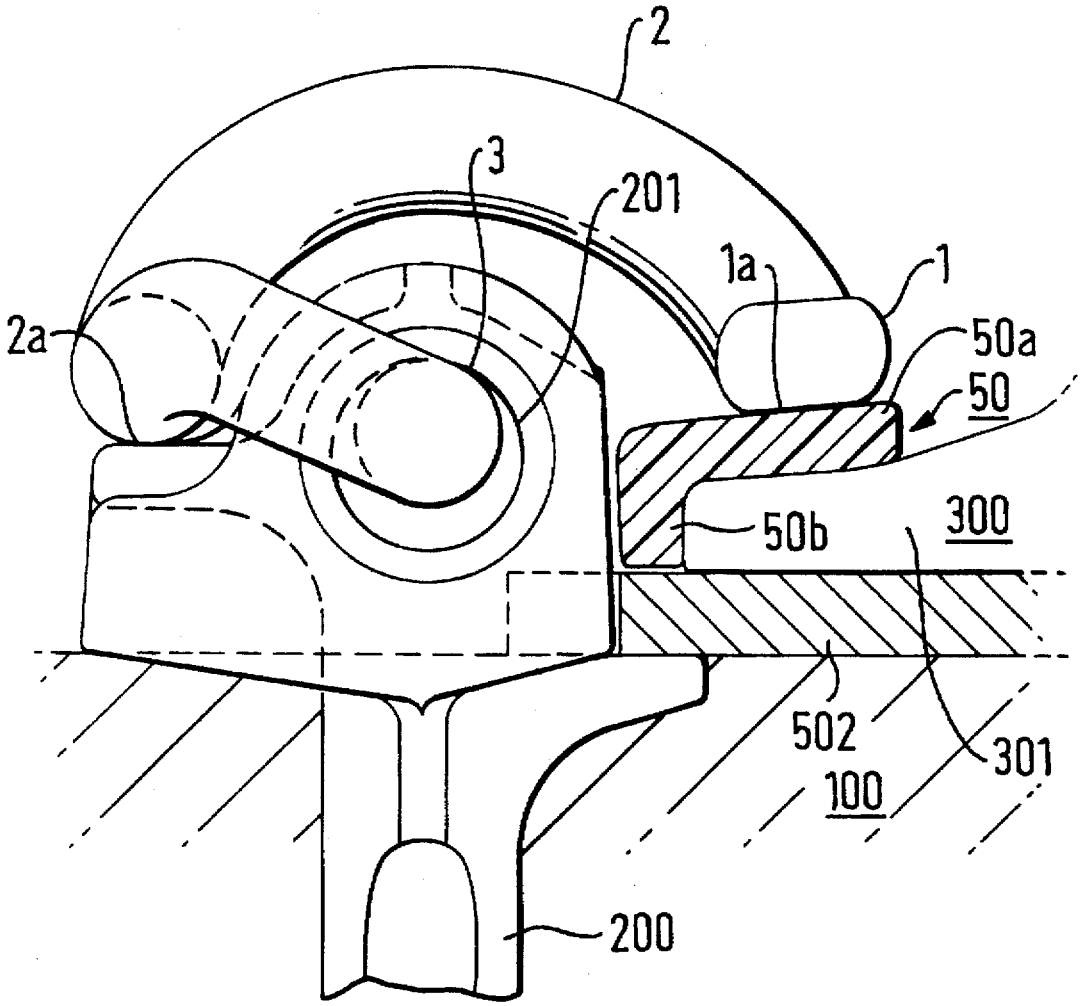
FIG. 3 PRIOR ART
FIG. 3 shows in transverse section a rail fastening assembly including an e-shaped clip of FIG. 1.

FIGS. 1 and 2 show, respectively, an e-shaped and a Z-shaped clip. FIG. 3 shows a rail fastening assembly including the e-shaped clip of FIG. 1, but the Z-shaped clip of FIG. 2 may alternatively be used therewith. The clips of FIGS. 1 and 2 and the arrangement of FIG. 3 are representative of the clips and arrangements as published under GB 1,510,224 and U.S. Pat. No. 4,304,359. The clips of FIGS. 1 and 2 each comprise a free end portion 1, a crossover arm 2 and a central leg 3. The crossover arm 2 has a heel part 2*a* which, in use, bears on part of an anchoring device or shoulder 200 secured to a rail foundation 100 adjacent to a rail 300 to be fastened. Similarly, the free end portion 1 has a rail bearing portion or toe 1*a* which bears on a flange 301 of the rail 300. The central leg 3 is received in a housing 201 in the shoulder 200 and the toe portion 1*a* bears on a one-part insulating member 50 on the upper surface of the rail flange 301. The insulating member 50 has a toe portion 50*a* which is seated on the rail flange 301 and a post portion 50*b* which extends between the edge of the rail flange 301 and an adjacent part of the shoulder 200.

Figure 4A:
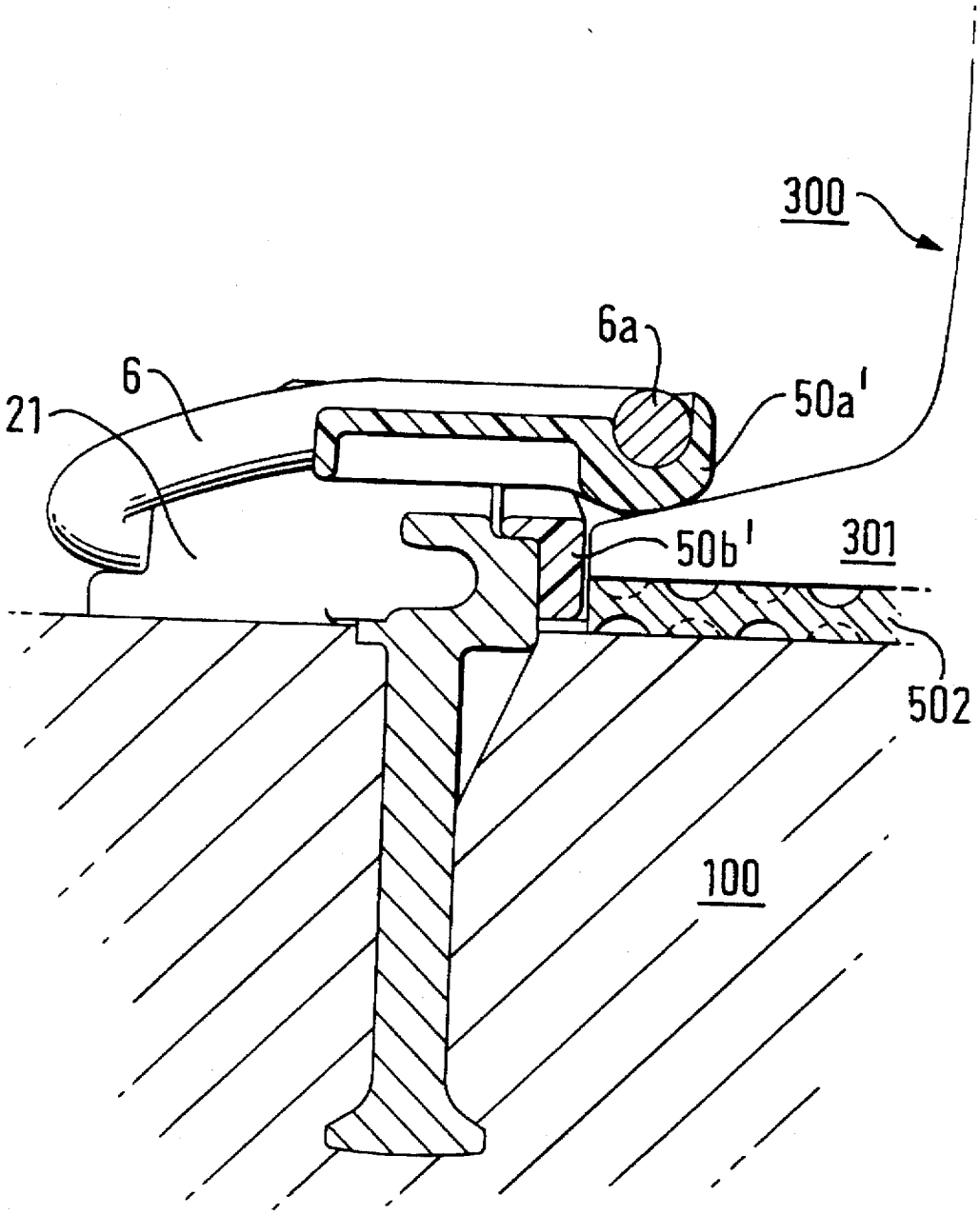
FIG. 4a PRIOR ART
FIGS. 4*a* and 4*b* show respective transverse sectional and plan views of a rail fastening assembly including an M-shaped clip.
Figure 4B:
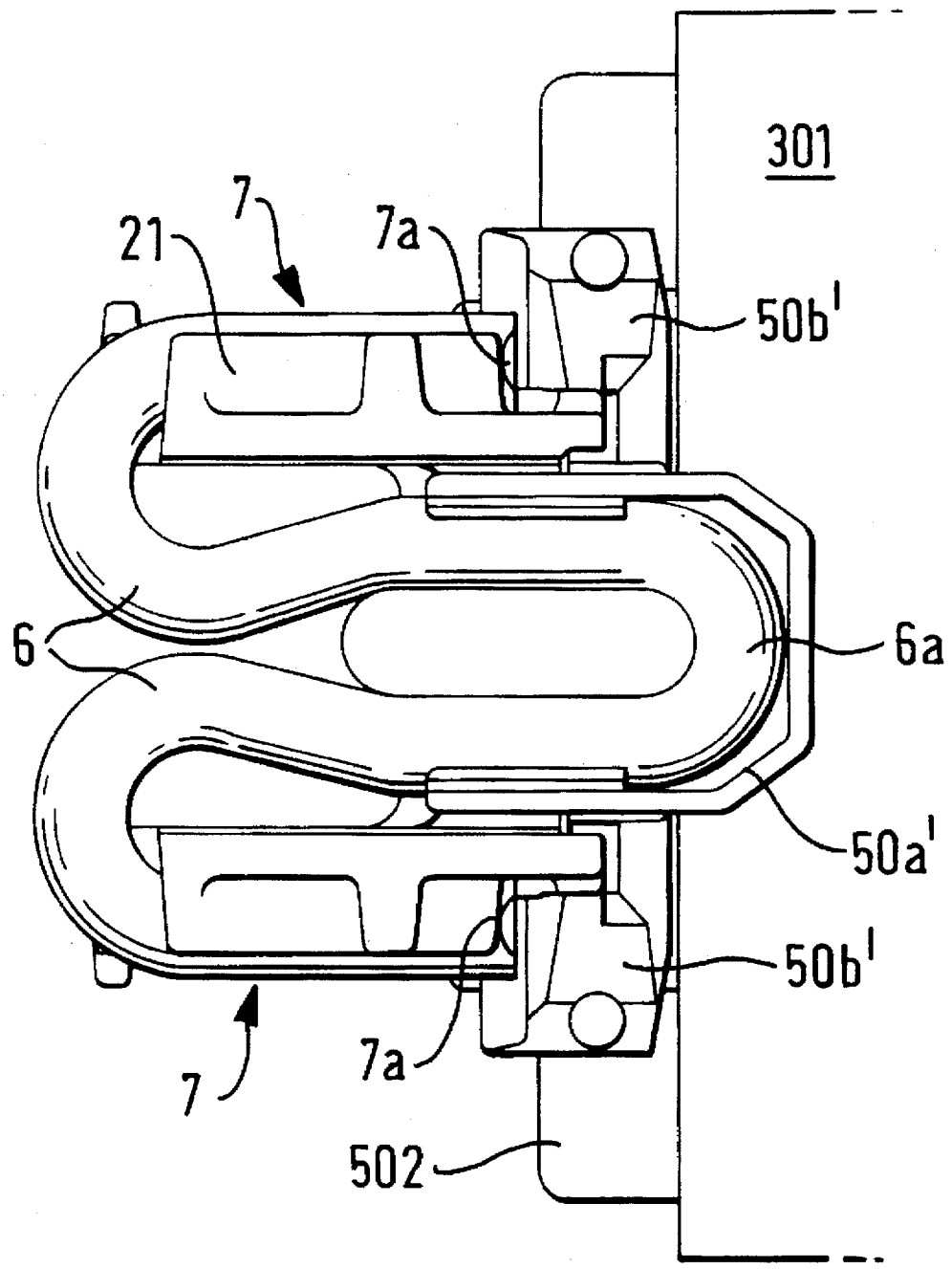
FIG. 4 b PRIOR ART

FIGS. 4*a* and 4*b* show a clip, which is M-shaped in plan, in an operative disposition in a rail fastening assembly. The M-shaped clip is similar to that described in WO93/12296. A part joining the inner legs 6 of the M serves as a rail bearing portion 6*a*, free ends 7*a* of the outer legs 7 of the M engaging a shoulder 21. The assembly of FIGS. 4*a* and 4*b* also comprises respective toe and post insulators 50*a*' and 50*b*', the toe insulator 50*a*' being carried by the rail bearing portion 6*a* of the clip.

Figure 5:
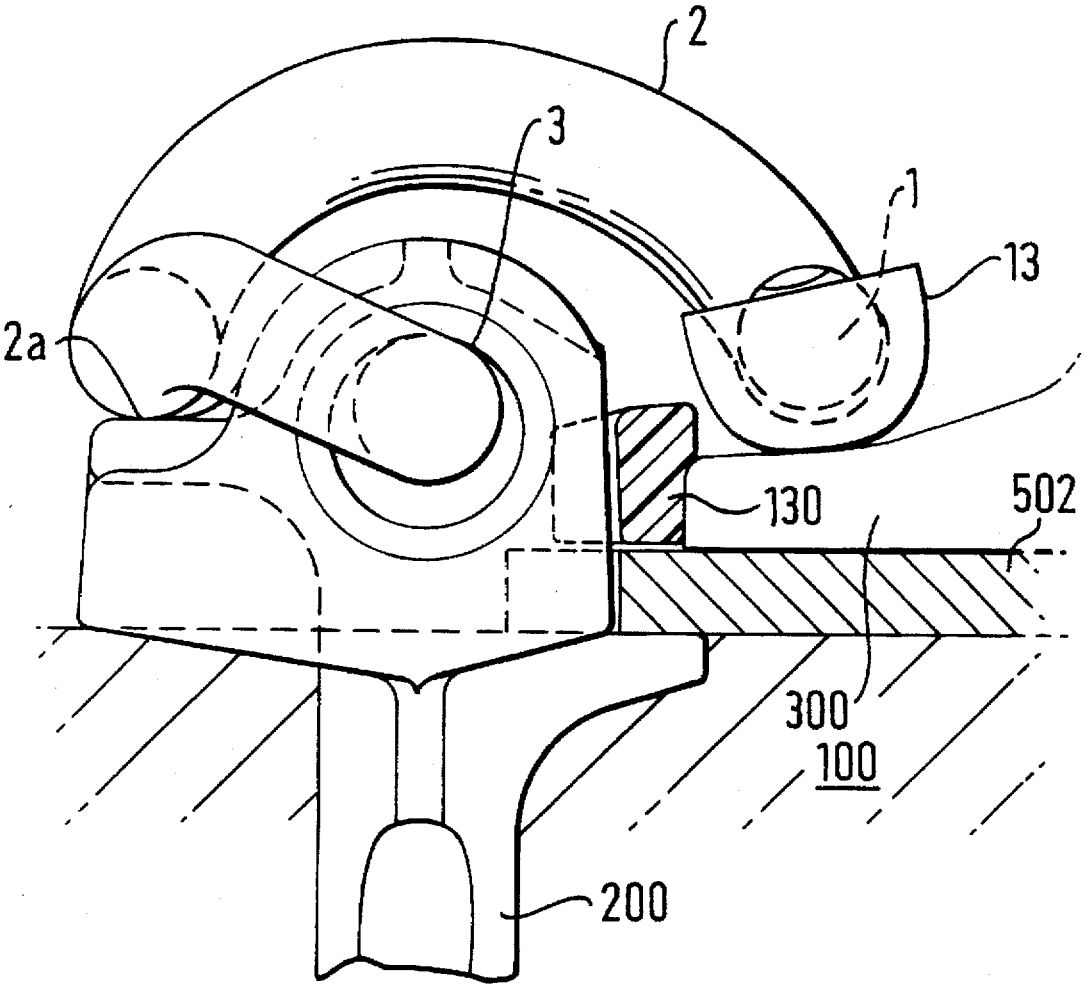
FIG. 5 shows in transverse section a rail fastening assembly including a clip and insulator arrangement embodying the present invention.
Figure 8A:
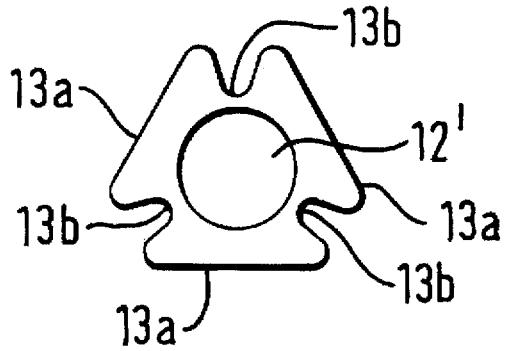
FIGS. 8*a*, 8*b*, 8*c* and 8*d* show respective end-on views of further insulators for use in an assembly embodying the present invention.
Figure 8B:
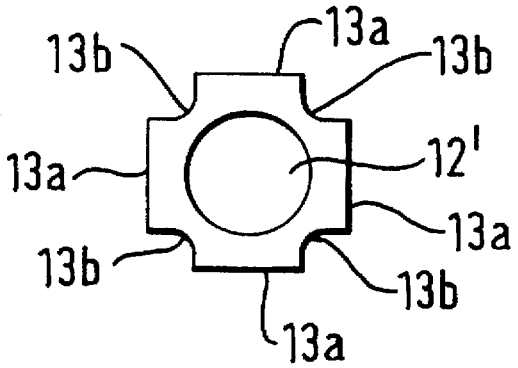
Figure 8C:
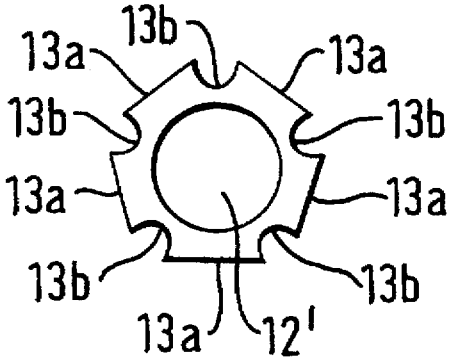
Figure 8D:
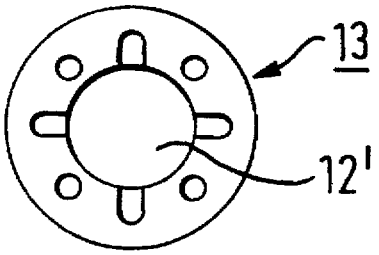

The rail fastening assembly of FIG. 5 is similar to that of FIG. 3 in some respects, and like parts in FIG. 5 are denoted by the same reference numerals as have been used in FIG. 3. Unlike the assembly of FIG. 3, however, the assembly of FIG. 5 has a two-part insulator system comprising a post insulator 130 and a toe insulator 13, which toe insulator 13 is rotatable about the longitudinal axis of the toe portion 1 of the clip.

The toe insulator 13 of FIG. 5 is shown in more detail in FIGS. 6*a* and 6*b*. The insulator 13 has a load bearing surface 13*c* which is semi-circular in cross-section, and a longitudinal recess 12, having a depression 14 formed at the closed end of the insulator, for clipping onto the rail bearing portion of an appropriately adapted clip, such as that shown in FIG. 10*d*.

A modified form of the toe insulator 13 of FIGS. 6*a* and 6*b* is shown in FIGS. 7*a* and 7*b*. The transverse cross-section of this insulator 13' resembles part of a hexagon, except insofar that the material which would otherwise form the corners of the hexagon has been omitted to allow clearance as the pad beneath the rail wears. Thus, in this case the external surface of the insulator 13' has three substantially equally-sized faces 13*a*, each having a slight radius, between which there are grooves 13*b*.

FIGS. 8*a* to 8*d* show alternative insulator shapes. The insulator of FIG. 8*a* has a triangular cross-section, that of FIG. 8*b* a square cross-section, that of FIG. 8*c* a pentagonal cross-section and that of FIG. 8*d* a circular cross-section. It should be noted that these examples are merely some of many possible insulator shapes.

In the insulators 13, 13' of FIGS. 6, 7 and 8 the recess 12 or passageway 12' is centrally located, but if the insulator is to be used for height adjustment, as described above, the recess 12 or passageway 12' is offset, as shown in FIG. 9.

FIGS. 10*a* to 10*d* show examples of the way in which the toe portions 1*a* of clips to which the invention is applied may be adapted to retain the insulator in such a way as to prevent longitudinal displacement thereof in use whilst permitting rotation of the insulator.

Figure 10A:
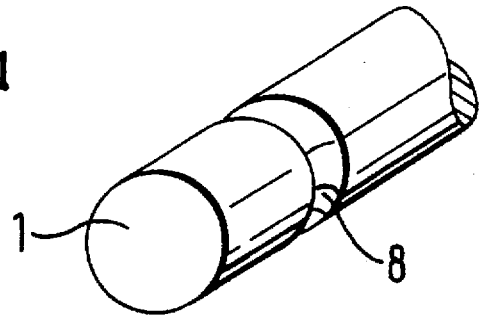
FIGS. 10*a*, 10*b*, 10*c* and 10*d* show respective perspective views of the toe portions of clips for use in an assembly embodying the present invention.
Figure 10B:
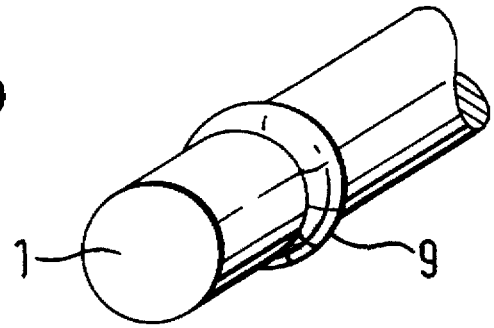
Figure 10C:
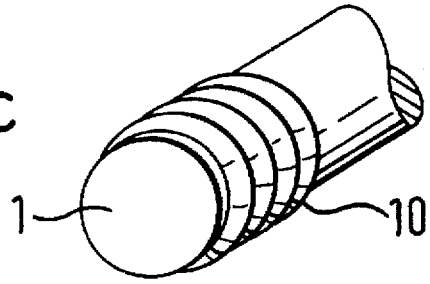
Figure 10D:
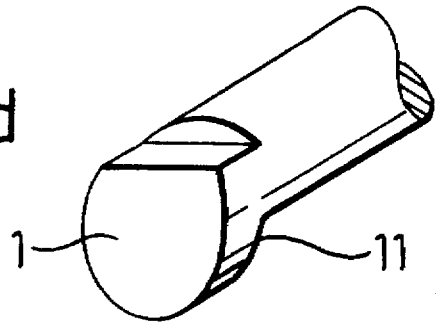

FIG. 10*a* shows an annular groove 8 formed on the toe portion 1*a* of a clip intended to be used with an insulator 13, 13' having a circumferential protrusion formed inside the recess 12 or passageway 12' thereof. FIG. 10*b* shows an annular projection 9 formed on the toe portion 1*a* of a clip intended to be used with an insulator 13, 13' having a circumferential groove formed inside the recess 12 or passageway 12' thereof. FIG. 10*c* shows the toe 1*a* of a clip formed with a rolled thread 10 to engage with a corresponding thread formed within the recess 12 or passageway 12' of an insulator 13, 13' FIG. 10*d* shows an offset 11 formed at the toe portion 1*a* of a clip for engaging a recess or depression 14 in an insulator 13 such as shown in FIG. 6*a*. Although formation of the offset 11 shown in FIG. 10*d* has deformed the transverse cross-section of the clip at this region, it is possible that the offset might be achieved such that the transverse cross-section of the clip remains unchanged, the axis of this part of the clip merely being displaced.

In each case the connection between the insulator of FIGS. 5 to 11 and the rail bearing portion of the clip must be loose enough to allow the desired degree of rotation of the insulator on the toe of the clip, such that under the forces applied thereto in use the insulator is caused to rotate about the clip toe so as to substantially maintain optimum contact between the insulator and the rail flange.

It should be noted that insulators for use in assemblies embodying the present invention are preferably attached to the clips before delivery to the site of installation.

We claim:

1. An assembly for use in fastening a railway rail to an underlying rail foundation, which assembly comprises a resilient railway rail fastening clip retained within a non-resilient clip housing secured to the rail foundation, which clip has at least one portion of substantially circular cross-section which when in use bears on, and extends substantially parallel to, a flange of an adjacent railway rail, and an insulator for electrically insulating the clip from the rail which is retained on the rail bearing portion of the clip when in use, wherein the insulator is held in engagement with the clip and is configured to allow rotational displacement of the insulator, under normal operating conditions, about the longitudinal axis of said rail bearing portion, whereby the insulator is self-aligning on the rail flange.

2. An assembly as claimed in claim 1, wherein the insulator has a cylindrical load bearing surface.

3. An assembly as claimed in claim 1, wherein the insulator has a hemi-cylindrical load bearing surface.

4. An assembly as claimed in claim 1, wherein the insulator has two or more load bearing surfaces, and in use the insulator may be rotationally displaced so as to change which of the load bearing surfaces of the insulator is presented to the rail flange.

5. An assembly as claimed in claim 4, wherein the thickness of material between the load bearing surfaces and a surface of the insulator which contacts the rail bearing portion of the clip is made to vary between adjacent load bearing surfaces, such that the insulator can be rotated so as to adjust the height of the rail bearing portion above the rail flange.

6. An assembly as claimed in claim 1, wherein the insulator is formed with a longitudinal recess shaped so as to clip onto the rail bearing portion of the clip.

7. An assembly as claimed in claim 1, wherein the insulator is formed with a passageway therein to receive the rail bearing portion of the clip.

8. An assembly as claimed in claim 6 or 7, wherein the recess or passageway is blank at one end.

9. An assembly as claimed in claim 1, wherein the said rail bearing portion of the said clip is at a free end of the clip.

10. An assembly as claimed in claim 1, wherein part of the said rail bearing portion of the clip cooperates with part of the said insulator so as to limit longitudinal displacement of the insulator on the said rail bearing portion during driving of the clip onto the rail flange, whilst permitting rotational displacement thereof.

11. An assembly as claimed in claim 10, wherein the rail bearing portion of the rail fastening clip includes an axially-local change or displacement in transverse cross-section which is adapted to engage with a corresponding change in internal cross-section of the said insulator.

12. An assembly as claimed in claim 11, wherein the axially-local change or displacement in transverse cross-section comprises one or more recesses or circumferential grooves.

13. An assembly as claimed in claim 11, wherein the axially-local change or displacement in transverse cross-section comprises an offset, one or more tabs, or circumferential protrusions.

14. An assembly as claimed in claim 11, wherein the axially-local change in transverse cross-section comprises a threaded portion.

15. An assembly as claimed in claim 11, wherein the axially-local change in transverse cross-sectiond comprises one or more tabs acting as stops at one or both ends of the rail bearing portion of the clip.

* * * * *